US010764684B1

(12) United States Patent
Sheaffer et al.

(10) Patent No.: US 10,764,684 B1
(45) Date of Patent: Sep. 1, 2020

(54) BINAURAL AUDIO USING AN ARBITRARILY SHAPED MICROPHONE ARRAY

(71) Applicant: Apple Inc., Cupertino, CA (US)

(72) Inventors: Jonathan D. Sheaffer, Santa Clara, CA (US); Ashrith Deshpande, San Jose, CA (US); Joshua D. Atkins, Los Angeles, CA (US)

(73) Assignee: Katherine A. Franco

( * ) Notice: Subject to any disclaimer, the term of this patent is extended or adjusted under 35 U.S.C. 154(b) by 0 days.

(21) Appl. No.: 16/147,140

(22) Filed: Sep. 28, 2018

Related U.S. Application Data

(60) Provisional application No. 62/566,277, filed on Sep. 29, 2017.

(51) Int. Cl.
*H04R 5/027* (2006.01)
*H04R 1/40* (2006.01)

(52) U.S. Cl.
CPC ..... *H04R 5/027* (2013.01); *H04R 1/406* (2013.01); *H04S 2420/01* (2013.01)

(58) Field of Classification Search
CPC .. H04R 2201/401; H04R 1/406; H04R 1/326; H04R 5/027; H04R 29/005; H04R 2430/20; H04R 3/04; H04R 3/12; H04R 5/00; H04R 1/02; H04R 1/08; H04R 1/20; H04R 1/40; H04R 2201/021; H04R 2201/40; H04R 2203/12; H04R 2430/03; H04R 2430/21; H04R 2430/23; H04R 3/02; H04R 5/023; H04H 20/89; G10K 11/178; G10K 11/346; G10K 2210/108; G10K 2210/12; G10K 2210/3028; H04M 2203/509; H04M 3/56
USPC ..... 381/17–23, 1, 312, 92, 61, 63, 320
See application file for complete search history.

(56) References Cited

U.S. PATENT DOCUMENTS

| | | | | |
|---|---|---|---|---|
| 7,706,543 | B2 * | 4/2010 | Daniel | G10H 1/0091 381/17 |
| 2006/0045275 | A1 | 3/2006 | Daniel | |
| 2009/0028347 | A1 | 1/2009 | Duraiswami | |
| 2009/0067636 | A1 | 3/2009 | Faure | |
| 2010/0329466 | A1 * | 12/2010 | Berge | H04R 3/12 381/22 |
| 2014/0355769 | A1 | 12/2014 | Peters | |
| 2015/0195644 | A1 * | 7/2015 | Wilson | H04R 1/40 381/92 |

(Continued)

*Primary Examiner* — Lun-See Lao
(74) *Attorney, Agent, or Firm* — Blank Rome LLP

(57) ABSTRACT

Systems, methods, and computer readable media to improve the operation of an electronic device having multiple microphones organized in an arbitrary, but known, arrangement in the device are described (i.e., having a specific form-factor). In general, techniques are disclosed for using a priori knowledge of an electronic device's spatial acoustic transfer functions to recreate or reconstitute a prior recorded three-dimensional (3D) audio field or environment. More particularly, techniques disclosed herein enable the efficient recording of a 3D audio field. That audio field may later be reconstituted using an acoustic characterization based on the device's form-factor. In addition, sensor data may be used to rotate the audio field so as to enable generating an output audio field that takes into account the listener's head position.

22 Claims, 5 Drawing Sheets

(56) References Cited

U.S. PATENT DOCUMENTS

| | | | | |
|---|---|---|---|---|
| 2015/0326966 | A1* | 11/2015 | Mehra | H04S 7/304<br>367/138 |
| 2016/0255452 | A1* | 9/2016 | Nowak | H04S 3/008<br>381/17 |
| 2018/0233123 | A1* | 8/2018 | Jin | H04R 3/02 |
| 2018/0249279 | A1* | 8/2018 | Karapetyan | H04R 3/04 |

* cited by examiner

BINAURAL AUDIO USING AN ARBITRARILY SHAPED MICROPHONE ARRAY

BACKGROUND

Binaural sound reproduction uses headphones to provide to the listener with auditory information congruent with real-world spatial sound cues. Binaural sound reproduction is key to creating virtual reality (VR) and/or augmented reality (AR) audio environments. Currently, binaural audio can be captured either by placing microphones at the ear canals of a human or a mannequin, or by manipulation of signals captured using spherical, hemispherical or cylindrical microphone arrays (i.e., those having a pre-defined, known idealized geometry).

SUMMARY

The following summary is included in order to provide a basic understanding of some aspects and features of the claimed subject matter. This summary is not an extensive overview and as such it is not intended to particularly identify key or critical elements of the claimed subject matter or to delineate the scope of the claimed subject matter. The sole purpose of this summary is to present some concepts of the claimed subject matter in a simplified form as a prelude to the more detailed description that is presented below.

In one embodiment the disclosed concepts provide methods to record and regenerate or reconstitute a three-dimensional (3D) binaural audio field using an electronic device having multiple microphones organized in an arbitrary, but known, arrangement on the device (i.e., having a specific form-factor). The method includes obtaining, from the plural microphones of the electronic device, audio data indicative of a 3D audio field; obtaining spatial acoustic transfer information for each of the electronic device's microphones, wherein the spatial acoustic transfer information is based on the electronic device's specific form-factor; applying the spatial acoustic transfer information to the audio data to obtain plane-wave decomposition (PWD) data representative of the 3D audio field, the PWD data corresponding to the electronic device's specific form-factor; and saving the PWD data in a memory of the electronic device.

In another one or more other embodiments, the binaural audio method further comprises retrieving the PWD data from the memory; obtaining head-related transfer information characterizing how a human listener receives a sound from a point in space, wherein the head-related transfer information is not based on the electronic device's specific form-factor; and combining the PWD data and the head-related transfer information to reconstitute a 3D audio field output data.

In still other embodiments, retrieving the PWD data comprises downloading, into the device's memory, the PWD data from a network-based storage system. In some embodiments, the binaural audio method uses conditioning matrix information that is configured to rotate the PWD data so that the reconstituted 3D audio field output data is rotated with respect to the PWD data. In yet other embodiments, obtaining conditioning matrix information comprises obtaining output from a sensor of the electronic device, wherein the sensor output is indicative of a position of the electronic device; and generating the conditioning matrix information based on the sensor output.

In one or more other embodiments, the various methods described herein may be embodied in computer executable program code and stored in a non-transitory storage device. In yet another embodiment, the method may be implemented in an electronic device having binaural audio capabilities.

DETAILED DESCRIPTION

Figure 1:
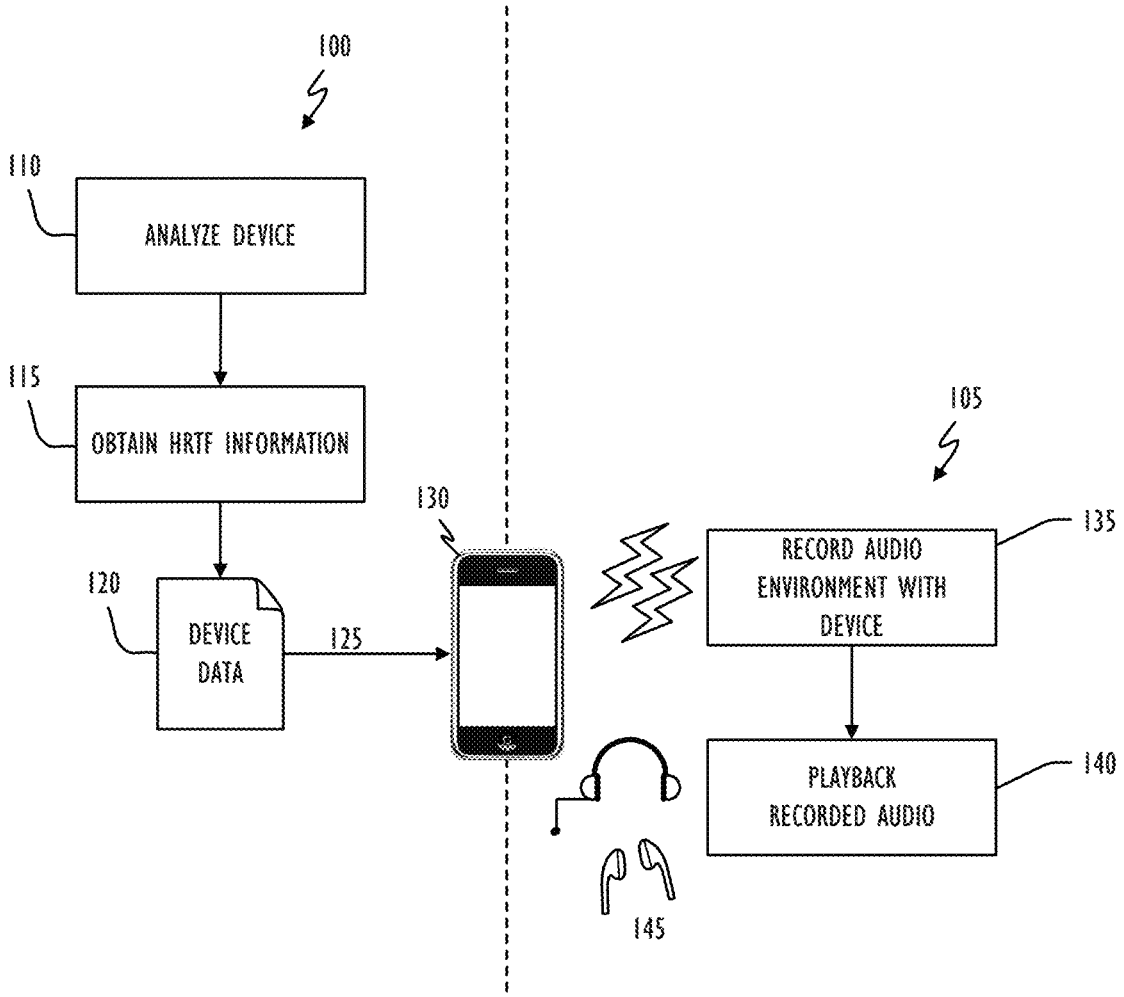
FIG. 1 shows, in flowchart form, a binaural audio operation in accordance with one or more embodiments.

This disclosure pertains to systems, methods, and computer readable media to improve the operation of an electronic device having multiple microphones organized in an arbitrary, but known, arrangement in the device (i.e., having a specific form-factor). In general, techniques are disclosed for using a priori knowledge of an electronic device's spatial acoustic transfer functions to recreate or reconstitute a prior recorded three-dimensional (3D) audio field or environment. More particularly, techniques disclosed herein enable the efficient recording of a 3D audio field. That audio field may later be reconstituted using an acoustic characterization based on the device's form-factor. In addition, sensor data may be used to rotate the audio field so as to enable generating an output audio field that takes into account the listener's head position.

In the following description, for purposes of explanation, numerous specific details are set forth in order to provide a thorough understanding of the disclosed concepts. As part of this description, some of this disclosure's drawings represent structures and devices in block diagram form in order to avoid obscuring the novel aspects of the disclosed concepts. In the interest of clarity, not all features of an actual implementation may be described. Further, as part of this description, some of this disclosure's drawings may be provided in the form of flowcharts. The boxes in any particular flowchart may be presented in a particular order. It should be understood however that the particular sequence of any given flowchart is used only to exemplify one embodiment. In other embodiments, any of the various elements depicted in the flowchart may be deleted, or the illustrated sequence of operations may be performed in a different order, or even concurrently. In addition, other embodiments may include additional steps not depicted as part of the flowchart. Moreover, the language used in this disclosure has been principally selected for readability and instructional purposes, and may not have been selected to delineate or circumscribe the inventive subject matter, resort to the claims being necessary to determine such inventive subject matter. Reference in this disclosure to "one embodiment" or to "an embodiment" means that a particular feature, structure, or characteristic described in connection with the embodiment is included in at least one embodiment of the disclosed subject matter, and multiple references to "one embodiment" or "an embodiment" should not be understood as necessarily all referring to the same embodiment.

It will be appreciated that in the development of any actual implementation (as in any software and/or hardware development project), numerous decisions must be made to achieve a developers' specific goals (e.g., compliance with system- and business-related constraints), and that these goals may vary from one implementation to another. It will also be appreciated that such development efforts might be complex and time-consuming, but would nevertheless be a routine undertaking for those of ordinary skill in the design and implementation of audio processing systems having the benefit of this disclosure.

Referring to FIG. 1, we see that some implementations of the disclosed binaural technology may be divided into two phases: phase-1 100 involves device characterization; phase-2 105 device use. In phase-1 100, a device having an arbitrary form-factor is obtained and it's acoustic properties analyzed (block 110). As used here, the term "form-factor" refers to the shape and composition of an electronic device and the number and placement of the device's microphones and speakers. Illustrative devices include, but are not limited to, smart phones and table computer systems. Head-related transfer-functions (HRTFs) describing how a sound from a specific point in three-dimensional (3D) space arrives at the ear of a listener can also be obtained (block 115). Data from these operations can be used to characterize the device resulting in device- or form-factor-specific data 120 which may be stored (arrow 125) on device 130 for subsequent use. While potentially complex or time-consuming to generate, device data need only be obtained once for each unique (specific) form-factor. In phase-2 105, device 130 may be used to record an audio environment (block 135) and, using form-factor-specific data 120, that audio environment may later be played back (block 140) using individual wired or wireless listening devices 145.

Figure 2:
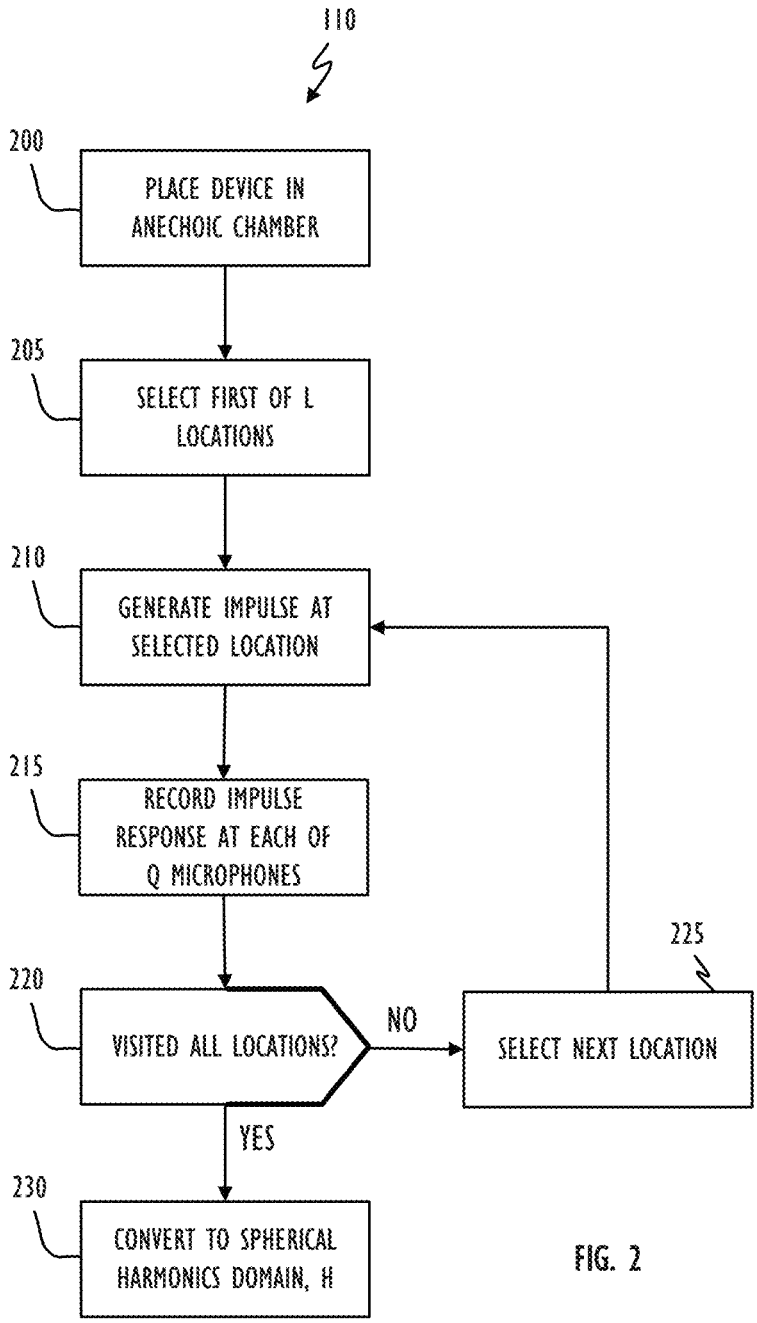
FIG. 2 shows, in flowchart form, a device analysis operation in accordance with one or more embodiments.

Referring to FIG. 2, device analysis operation 110 in accordance with one or more embodiments may be based on audio signals captured by an electronic device of arbitrary, but known, form-factor having a known but arbitrary arrangement of Q microphones. To begin, the electronic device may be placed into an anechoic chamber (block 200). A first of L locations is selected (block 205), where L represents the number of locations or directions from which an audio signal is to be produced. An impulse can then be generated from the selected location (block 210) and the impulse response recorded from each of the device's Q microphones (block 215). If an impulse from at least one of the L locations remains to be recorded (the "NO" prong of block 220), the next location is selected (block 225), where after operation 110 continues at block 210. If impulses from all L locations have been recorded by all Q microphones (the "YES" prong of block 220), the collected data may be converted into the spherical harmonics domain to generate spatial acoustic transfer functions (block 230). Since only a finite number of spatial samples can be taken, the measured impulse responses can be transformed into corresponding spherical harmonic coefficients and used to facilitate the spatial interpolation of a prior recorded audio field to generate a realistic 3D audio environment for a listener. While these a priori data are a prerequisite to the techniques described herein, they need be measured only once per device form-factor, and can then be stored locally on each device. It should be noted that the larger the number of locations from which an impulse is generated (i.e., L), the more accurate a subsequently reconstructed or reconstituted audio signal may be. However, the number of microphones (i.e., Q) and their positions on the device is also controlling of the reproduction accuracy.

With this background, let F be the number of frequency bins used during Fourier transform operations, and N the Spherical Harmonics order (with Q and Las defined above). Then:

$$p(\omega)=V\dot{a}(\omega)+s, \text{ where} \qquad \text{EQ. 1}$$

$p(\omega)$ represents the frequency (Fourier) domain representation of the audio input at a microphone ($p\in\mathbb{C}^{Q\times 1}$), V represents a transformation matrix that translates the space domain signals at the microphones to the spherical harmonics description of the sound field and is independent of what is being recorded ($V\in\mathbb{C}^{Q\times(N+1)^2}$), $\dot{a}(\omega)$ represents the plane-wave decomposition of the input audio signal and indicates at each frequency where each recorded audio signal comes from ($\dot{a}\in\mathbb{C}^{(NM)^2\times 1}$), and s represents a microphone's noise characteristics (in the frequency domain).

The following expresses the relationship between matrix V (see above) and the spherical harmonics representation of the anechoic audio data captured in accordance with FIGS. 1 and 2:

$$V=HY, \text{ where} \qquad \text{EQ. 2}$$

V is as described above, His a spherical harmonic representation of the device's recorded impulse responses also referred to as the electronic device's spatial acoustic transfer functions ($H\in\mathbb{C}^{L\times QF}$), and Y is a matrix of spherical harmonic basis functions ($Y\in\mathbb{C}^{L\times(NM)^2}$). Individual elements of Y may be determined in accordance with any of a number of conventional closed-form solutions.

Solving EQ. 1 for $\dot{a}(\omega)$:

$$\dot{a}(\omega)=V^{\dagger}p(\omega)+s, \text{ where} \qquad \text{EQ. 3}$$

$V^{\dagger}$ represents the pseudo-inverse of V. Using a Hermitian (complex) transpose:

$$V^{\dagger}=(V^{H}V)^{-1}V^{H}, \text{ where} \qquad \text{EQ. 4}$$

$V^{H}$ represents the Hermitian transpose of matrix V. Substituting EQ. 4 into EQ. 3 gives:

$$\dot{a}(\omega)=[(V^{H}V)^{-1}V^{H}]p(\omega)+\dot{s} \qquad \text{EQ. 5}$$

Substituting EQ. 2 into EQ. 5 so as to use known quantities results in:

$$\dot{a}(\omega)=\{[(HY)^{H}HY]^{-1}(HY)^{H}\}p(\omega)+\dot{s}. \qquad \text{EQ. 6}$$

The value $[(V^{H}V)^{-1}V^{H}]$ or $\{[(HY)^{H}HY]^{-1}(HY)^{H}\}$ may be precomputed based on anechoic data about the device (e.g., spatial acoustic transfer information based on the device's specific form-factor). Accordingly, at run-time when a recording is being made (e.g., in accordance with block 135) only a minimal amount of computation need be performed for each microphone's output. That is, the plane-wave decomposition of the audio environment at each microphone may be obtained in real-time with little computational overhead. In another embodiment, raw audio output from each microphone may be recorded so that at playback time it can be transformed into the frequency or Fourier domain and $\dot{a}(\omega)$ determined in accordance with EQS. 5 and 6. In still another embodiment, microphone output could be converted into the frequency domain before being stored.

By way of example, in one embodiment L=1536 (96 locations in the azimuth direction and 13 in the elevation direction). In another embodiment L=1024 (64 locations in the azimuth direction and 16 in the elevation direction). In still another embodiment, L=936 (72 locations in the azimuth direction and 13 in the elevation direction). In yet another embodiment, L=748 (68 locations in the azimuth direction and 11 in the elevation direction). In each embodiment, Q may be greater than or equal to 2. As noted above, the size of both L and Q are controlling with respect to the quality of the generated or reconstituted audio field.

As with electronic device 130 itself, HRTF acquisition operation 115 can include placing an mannequin (or individual) into an anechoic chamber and recording the sound at each ear position as impulses are generated from a number of different locations. The response to these impulses can be measured with microphones located coincident with the mannequin's ears (left and right). Anechoic HRTF time-domain data may be transformed into the frequency or Fourier domain and then into spherical harmonics coefficients to give:

$$g^{l/r}(\omega), \text{ where} \qquad \text{EQ. 7}$$

superscripts l/r indicates a left or right ear recording, and ω represents HRTF data g( ) is in the frequency domain ($\dot{g} \in \mathbb{C}^{(N+1)^2 \times 1}$). HRTF data $g^{l/r}(\omega)$ may also be captured once and stored on the device as part of device data 120.

Figure 3:
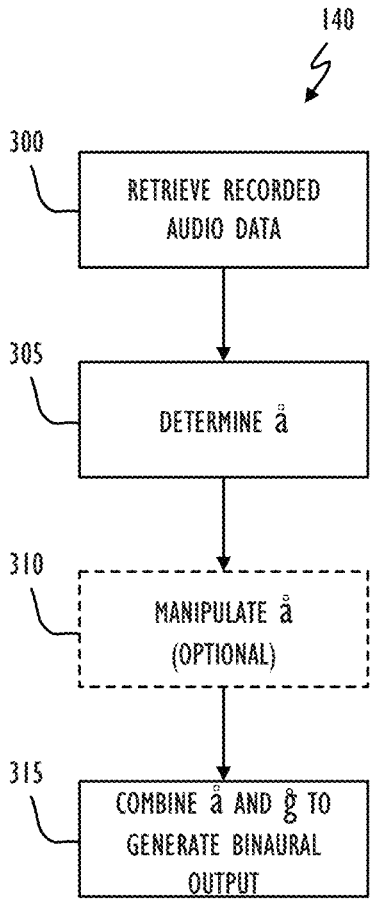
FIG. 3 shows, in flowchart form, a binaural audio field reconstruction operation in accordance with one or more embodiments.

Referring to FIG. 3, binaural audio playback operation 140 in accordance with one or more embodiments begins with retrieval of recorded audio environment data (block 300). In one embodiment for example, audio data may be retrieved from storage on the electronic device itself. In another embodiment, audio data may be retrieved from a cloud- or network-based storage system. In still another embodiment, audio data may be obtained directly from another electronic device (e.g., using the Bluetooth® communication's protocol). (BLUETOOTH is a registered trademark of Bluetooth Sig, Inc.) As noted above, the originally recorded audio environment may be "raw" data from each microphone (e.g., in the time-domain), or it could be in the frequency domain, or it could be in a plane-wave decomposition form as spherical harmonic coefficients in accordance with EQ. 6. As needed, the plane-wave decomposition (PWD) of $p(\omega)$–$\dot{a}(\omega)$—is determined as illustrated above in EQS. 1-4 (block 305). Optionally, the audio input's PWD representation may be manipulated (block 310). In one embodiment, spectral equalization may be applied to $\dot{a}(\omega)$. In another embodiment, $\dot{a}(\omega)$ may be rotated to accommodate the listener's head position. In yet another embodiment, both conditioning operations and rotation may be applied to $\dot{a}(\omega)$. By way of example, if electronic device 130 or listening devices 145 incorporate one or more sensors capable of indicating the listener's head rotation (relative to the position at which the audio environment was recorded), this information may be used to rotate the audio field at playback time (e.g., through the use of Wigner-D matrices). That is, the sound field generated in accordance with block 140 may be manipulated so that the sound heard by a listener is dependent upon the listener's head rotation. In another embodiment, the sound field may be generated without accounting for the listener's head rotation. PWD representation $\dot{a}(\omega)$ and HRTF characterization $\dot{g}(\omega)$ may be combined as follows to generate a frequency domain audio-field output (block 315):

For left and right ears:
For each frequency, ω, obtain input signal $p(\omega)$
{
Determine: $\dot{a}(\omega)=V^{\dagger}p(\omega)+s$
Perform sound field manipulation using conditioning Matrix D and combine with HRTFs using $\dot{g}(\omega)$:

$$y^{l/r}(\omega)=(D\dot{g}(\theta))^{H}\dot{a}(\omega) \qquad \text{EQ. 8}$$

}
Convert $y^{l}(\omega)$ and $y^{r}(\omega)$ into the time-domain and supply to listening devices (e.g., 145).

Here $y^{l}(\omega)$ and $y^{r}(\omega)$ represent the regenerated or reconstituted audio field in the frequency domain for the left and right ears respectively, D represents a conditioning matrix as described above ($D \in \mathbb{C}^{(N+1)^2 \times (N+1)^2}$), and $(X)^{H}$ represents the Hermitian of matrix X. In one or more embodiments, conditioning or rotation matrix D may be precomputed. Output in accordance with this disclosure (e.g., EQ. 8) provides a realistic 3D sound field as recorded by an electronic device having an arbitrary, but known, form-factor. It should also be noted that the approach described herein decouples HRTF ($\dot{g}(\omega)$) from head rotation operation (D).

Figure 4:
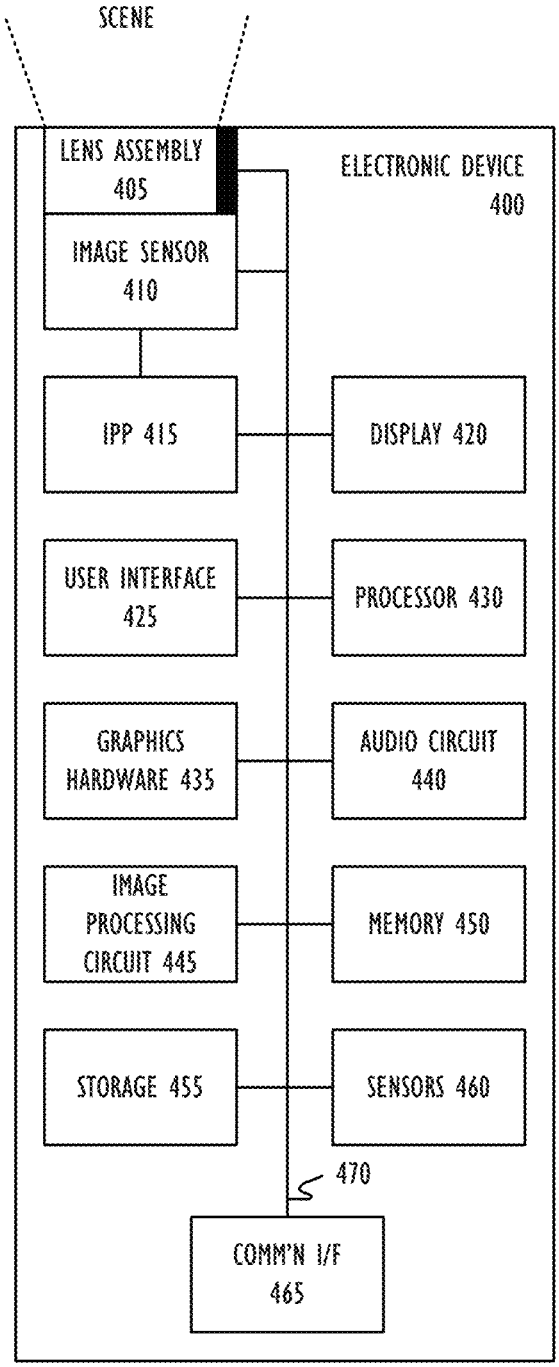
FIG. 4 shows, in block diagram form, a portable electronic device in accordance with another one or more embodiments.

Referring to FIG. 4, a simplified functional block diagram of illustrative electronic device 400 is shown according to one or more embodiments. Electronic device 400 may be used to acquire and generate binaural audio fields in accordance with this disclosure. As noted above, an illustrative electronic device 400 could be a mobile telephone (aka, a smart phone), a personal media device or a notebook computer system. As shown, electronic device 400 may include lens assemblies 405 and image sensors 410 for capturing images of a scene. By way of example, lens assembly 405 may include a first assembly configured to capture images in a direction away from the device's display 420 (e.g., a rear-facing lens assembly) and a second lens assembly configured to capture images in a direction toward or congruent with the device's display 420 (e.g., a front facing lens assembly). In one embodiment, each lens assembly may have its own sensor (e.g., element 410). In another embodiment, each lens assembly may share a common sensor. In addition, electronic device 400 may include image processing pipeline (IPP) 415, display element 420, user interface 425, processor(s) 430, graphics hardware 435, audio circuit 440, image processing circuit 445, memory 450, storage 455, sensors 460, communication interface 465, and communication network or fabric 470.

Lens assembly 405 may include a single lens or multiple lens, filters, and a physical housing unit (e.g., a barrel). One function of lens assembly 405 is to focus light from a scene onto image sensor 410. Image sensor 410 may, for example, be a CCD (charge-coupled device) or CMOS (complementary metal-oxide semiconductor) imager. IPP 415 may process image sensor output (e.g., RAW image data from sensor 410) to yield a HDR image, image sequence or video sequence. More specifically, IPP 415 may perform a number of different tasks including, but not be limited to, black level removal, de-noising, lens shading correction, white balance adjustment, demosaic operations, and the application of local or global tone curves or maps. IPP 415 may comprise a custom designed integrated circuit, a programmable gate-array, a central processing unit (CPU), a graphical processing unit (GPU), memory, or a combination of these elements (including more than one of any given element). Some functions provided by IPP 415 may be implemented at least in part via software (including firmware). Display element 420 may be used to display text and graphic output as well as receiving user input via user interface 425. For example, display element 420 may be a touch-sensitive display screen. User interface 425 can also take a variety of other forms such as a button, keypad, dial, a click wheel, and keyboard. Processor 430 may be a system-on-chip (SOC) such as those found in mobile devices and include one or more dedicated CPUs and one or more GPUs. Processor circuit 430 may be used (in whole or in part) to record and/or recreate a binaural audio field in accordance with this disclosure. Processor 430 may be based on reduced instruction-set computer (RISC) or complex instruction-set computer (CISC) architectures or any other suitable architecture and each computing unit may include one or more processing cores. Graphics hardware 435 may be special purpose computational hardware for processing graphics and/or assisting processor 430 perform computational tasks. In one embodiment, graphics hardware 435 may include one or more programmable GPUs each of which may have one or more cores. Audio circuit 440 may include two or more microphones, two or more speakers and one or more audio codecs. The microphones may be used to record a binaural audio field in accordance with this disclosure. The speakers and/or audio output via earbuds or headphones (not shown) may be used to recreate a prior recorded binaural audio field in accordance with this disclosure. Image processing circuit 445 may aid in the capture of still and video images from image sensor 410 and include at least one video codec. Image processing circuit 445 may work in concert with IPP 415, processor 430 and/or graphics hardware 435. Audio data, once captured, may be stored in memory 450 and/or storage 455. Memory 450 may include one or more different types of media used by IPP 415, processor 430, graphics hardware 435, audio circuit 440, and image processing circuitry 445 to perform device functions. For example, memory 450 may include memory cache, read-only memory (ROM), and/or random access memory (RAM). Storage 455 may store media (e.g., audio, image and video files), computer program instructions or software, preference information, device profile information, and any other suitable data. Storage 455 may also be used to store a recorded audio environment in accordance with this disclosure. Storage 455 may include one more non-transitory storage mediums including, for example, magnetic disks (fixed, floppy, and removable) and tape, optical media such as CD-ROMs and digital video disks (DVDs), and semiconductor memory devices such as Electrically Programmable Read-Only Memory (EPROM), and Electrically Erasable Programmable Read-Only Memory (EEPROM). Device sensors 460 may include, but need not be limited to, one or more of an optical activity sensor, an optical sensor array, an accelerometer, a sound sensor, a barometric sensor, a proximity sensor, an ambient light sensor, a vibration sensor, a gyroscopic sensor, a compass, a magnetometer, a thermistor sensor, an electrostatic sensor, a temperature sensor, and an opacity sensor. In one or more embodiments, sensors 460 may provide input so aid in determining a listener's head rotation. Communication interface 465 may be used to connect device 400 to one or more networks. Illustrative networks include, but are not limited to, a local network such as a universal serial bus (USB) network, an organization's local area network, and a wide area network such as the Internet. Communication interface 465 may use any suitable technology (e.g., wired or wireless) and protocol (e.g., Transmission Control Protocol (TCP), Internet Protocol (IP), User Datagram Protocol (UDP), Internet Control Message Protocol (ICMP), Hypertext Transfer Protocol (HTTP), Post Office Protocol (POP), File Transfer Protocol (FTP), and Internet Message Access Protocol (IMAP)). Communication network or fabric 470 may be comprised of one or more continuous (as shown) or discontinuous communication links and be formed as a bus network, a communication network, or a fabric comprised of one or more switching devices (e.g., a cross-bar switch).

Figure 5:
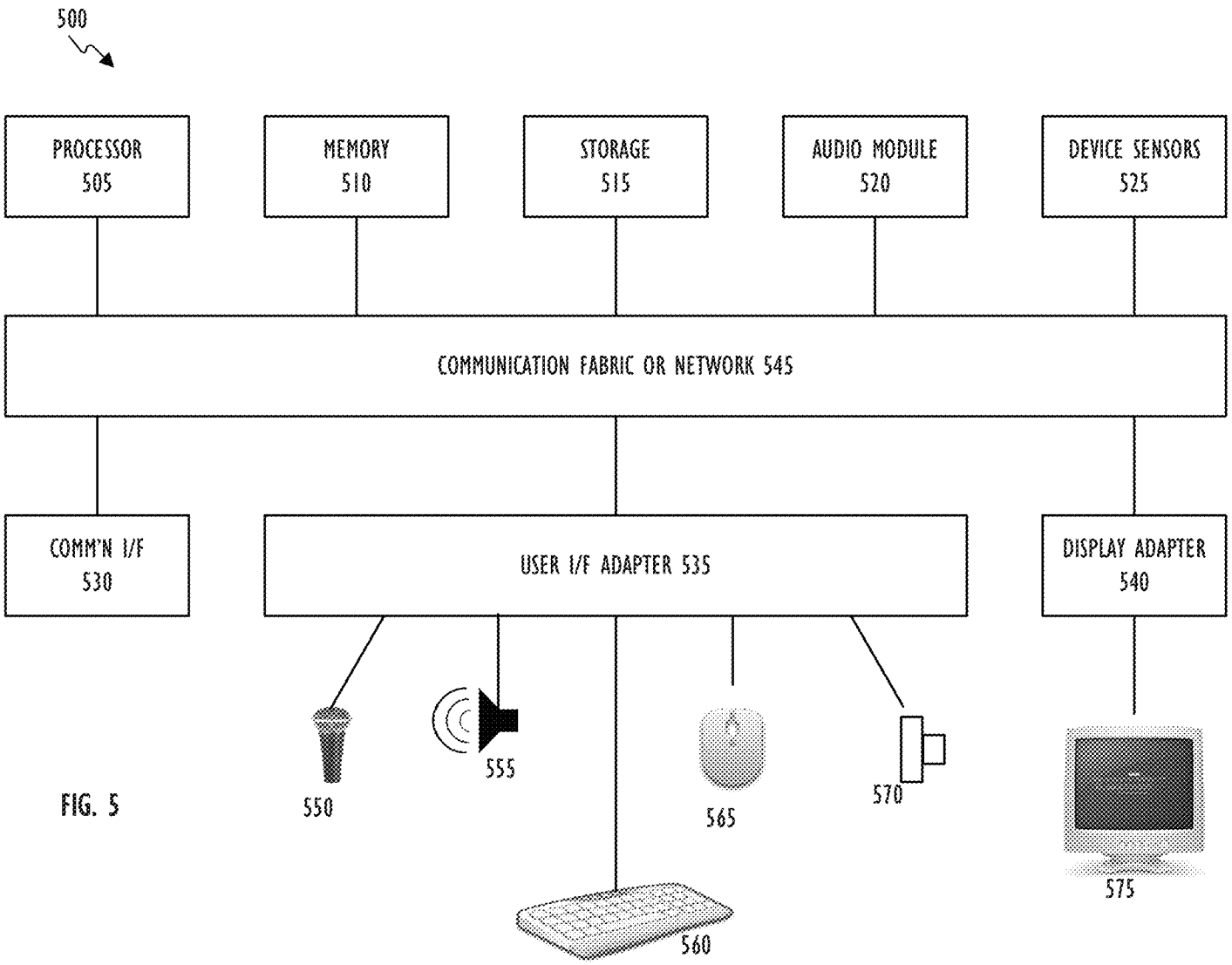
FIG. 5 shows, in block diagram form, a computer system in accordance with one or more embodiments.

Referring to FIG. 5, the disclosed binaural audio field operations may also be performed by representative computer system 500 (e.g., a general purpose computer system such as a desktop, laptop, or notebook computer system). Computer system 500 may include processor element or module 505, memory 510, one or more storage devices 515, audio circuit or module 520, device sensors 525, communication interface module or circuit 530, user interface adapter 535 and display adapter 540—all of which may be coupled via system bus, backplane, fabric or network 545.

Processor module 505, memory 510, storage devices 515, audio circuit or module 520, device sensors 525, communication interface 530, communication fabric or network 545 and display element 575 may be of the same or similar type and serve the same function as the similarly named component described above with respect to electronic device 400. User interface adapter 535 may be used to connect microphone(s) 550, speaker(s) 555, keyboard 560 (or other input devices such as a touch-sensitive element), pointer device(s) 565, and an image capture element 570 (e.g., an embedded image capture device). Display adapter 540 may be used to connect one or more display units 575.

It is to be understood that the above description is intended to be illustrative, and not restrictive. The material has been presented to enable any person skilled in the art to make and use the disclosed subject matter as claimed and is provided in the context of particular embodiments, variations of which will be readily apparent to those skilled in the art (e.g., some of the disclosed embodiments may be used in combination with each other). Accordingly, the specific arrangement of steps or actions shown in FIGS. 1-3 or the arrangement of elements shown in FIGS. 4-5 should not be construed as limiting the scope of the disclosed subject matter. The scope of the invention therefore should be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A non-transitory program storage device comprising instructions stored thereon to cause one or more processors to:

obtain, from plural microphones of an electronic device, audio data indicative of a three-dimensional (3D) audio field, the electronic device having a specific form-factor;

obtain spatial acoustic transfer information for each of the electronic device's microphones, wherein the spatial acoustic transfer information is based on the electronic device's specific form-factor, and wherein the spatial acoustic transfer information is based on a product of spherical harmonic basis functions (H) and spherical harmonic representations of recorded impulse responses (Y) associated with the specific form factor;

apply the spatial acoustic transfer information to the audio data to obtain plane-wave decomposition (PWD) data representative of the 3D audio field, the PWD data corresponding to the electronic device's specific form-factor; and save the PWD data in a memory of the electronic device.

2. The non-transitory program storage device of claim 1, wherein the instructions to obtain spatial acoustic transfer information comprise instructions to cause the one or more processors to obtain the spatial acoustic transfer information based on anechoic chamber data of a second electronic device, wherein the second electronic device also has the specific form-factor.

3. The non-transitory program storage device of claim 2, further comprising instructions to cause the one or more processors to obtain head-related transfer information, the head-related transfer information characterizing how a listening device receives a sound from a point in space, wherein the head-related transfer information is not based on the electronic device's specific form-factor.

4. The non-transitory program storage device of claim 3, further comprising instructions to cause the one or more processors to:

retrieve the PWD data from the memory; and combine the PWD data and the head-related transfer information to reconstitute a 3D audio field output data.

5. The non-transitory program storage device of claim 4, wherein the instructions to retrieve the PWD data from the memory comprise instructions to cause the one or more processors to download, into the memory, the PWD data from a network-based storage system.

6. The non-transitory program storage device of claim 3, further comprising instructions to cause the one or more processors to:

retrieve the PWD data from the memory;

obtain conditioning matrix information, wherein the conditioning matrix information is not based on the electronic device's specific form-factor; and combine the PWD data, the head-related transfer information, and the conditioning matrix information to reconstitute a 3D audio field output data, wherein the reconstituted 3D audio field output data comprises a left-channel portion and a right-channel portion.

7. The non-transitory program storage device of claim 6, wherein the conditioning matrix information is configured to rotate the PWD data so that the reconstituted 3D audio field output data is rotated with respect to the PWD data.

8. The non-transitory program storage device of claim 7, wherein the instructions to obtain conditioning matrix information comprise instructions to cause the one or more processors to:

obtain output from a sensor of the electronic device, wherein the sensor output is indicative of a position of the electronic device;

generate the conditioning matrix information based on the sensor output.

9. The non-transitory program storage device of claim 8, further comprising instructions to cause the one or more processors to send the left- and right-channel portions of the reconstituted 3D audio field output data to left and right individual listening devices.

10. An electronic device, comprising:

a memory;

plural microphones operatively coupled to the memory, the plural microphones arranged on the electronic device so as to embody a specific form-factor; and one or more processors operatively coupled to the memory and the microphones, the one or more processors configured to execute instructions stored in the memory to cause the one or more processors to— obtain, from the memory, audio data indicative of a three-dimensional (3D) audio field, obtain spatial acoustic transfer information for each of the plural microphones, wherein the spatial acoustic transfer information is based on the electronic device's specific form-factor, and wherein the spatial acoustic transfer information is based on a product of spherical harmonic basis functions (H) and spherical harmonic representations of recorded impulse responses (Y) associated with the specific form factor, apply the spatial acoustic transfer information to the audio data to obtain plane-wave decomposition (PWD) data representative of the 3D audio field, the PWD data corresponding to the electronic device's specific form-factor, and save the PWD data in the memory.

11. The electronic device of claim 10, wherein the memory further comprises instructions to cause the one or more processors to:

retrieve the PWD data from the memory;

obtain head-related transfer information characterizing how a listening device receives a sound from a point in space, wherein the head-related transfer information is not based on the electronic device's specific form-factor; and combine the PWD data and the head-related transfer information to reconstitute a 3D audio field output data.

12. The electronic device of claim 10, wherein the memory further comprises instructions to cause the one or more processors to:

retrieve the PWD data from the memory;

obtain conditioning matrix information, wherein the conditioning matrix information is not based on the electronic device's specific form-factor; and combine the PWD data, the head-related transfer information, and the conditioning matrix information to reconstitute a 3D audio field output data, wherein the reconstituted 3D audio field output data comprises a left-channel portion and a right-channel portion.

13. The electronic device of claim 12, wherein the conditioning matrix information is configured to rotate the PWD data so that the reconstituted 3D audio field output data is rotated with respect to the PWD data.

14. The electronic device of claim 13, wherein the instructions to obtain conditioning matrix information comprise instructions to cause the one or more processors to:

obtain output from a sensor of the electronic device, wherein the sensor output is indicative of a position of the electronic device;

generate the conditioning matrix information based on the sensor output.

15. The non-transitory program storage device of claim 1, wherein the spatial acoustic transfer information is equal to $[(HY)^H HY]^{-1} (HY)^H$, and wherein $(HY)^H$ is a Hermitian transpose matrix of (HY).

16. The non-transitory program storage device of claim 15, wherein applying the spatial acoustic transfer information to the audio data to obtain the PWD data includes determining a product of a frequency domain representation of the audio data and $[(HY)^H HY]^{-1} (HY)^H$.

17. A binaural audio method, comprising:

obtaining, from plural microphones of an electronic device, audio data indicative of a three-dimensional (3D) audio field, the electronic device having a specific form-factor;

obtaining spatial acoustic transfer information for each of the electronic device's microphones, wherein the spatial acoustic transfer information is based on the electronic device's specific form-factor, and wherein the spatial acoustic transfer information is based on a product of spherical harmonic basis functions (H) and spherical harmonic representations of recorded impulse responses (Y) associated with the specific form factor;

applying the spatial acoustic transfer information to the audio data to obtain plane-wave decomposition (PWD)

data representative of the 3D audio field, the PWD data corresponding to the electronic device's specific form-factor; and saving the PWD data in a memory of the electronic device.

18. The binaural audio method of claim 17, further comprising:

retrieving the PWD data from the memory;

obtaining head-related transfer information characterizing how a listening device receives a sound from a point in space, wherein the head-related transfer information is not based on the electronic device's specific form-factor; and combining the PWD data and the head-related transfer information to reconstitute a 3D audio field output data.

19. The binaural audio method of claim 17, further comprising:

retrieving the PWD data from the memory;

obtaining conditioning matrix information, wherein the conditioning matrix information is not based on the electronic device's specific form-factor; and combining the PWD data, the head-related transfer information, and the conditioning matrix information to reconstitute a 3D audio field output data, wherein the reconstituted 3D audio field output data comprises a left-channel portion and a right-channel portion.

20. The binaural audio method of claim 19, wherein the conditioning matrix information is configured to rotate the PWD data so that the reconstituted 3D audio field output data is rotated with respect to the PWD data.

21. The binaural audio method of claim 20, wherein obtaining conditioning matrix information comprises:

obtaining output from a sensor of the electronic device, wherein the sensor output is indicative of a position of the electronic device;

generating the conditioning matrix information based on the sensor output.

22. The binaural audio method of claim 21, further comprising sending the left- and right-channel portions of the reconstituted 3D audio field output data to left and right individual listening devices.

* * * * *